US006796158B2

(12) United States Patent
Brzezniak et al.

(10) Patent No.: US 6,796,158 B2
(45) Date of Patent: Sep. 28, 2004

(54) ADJUSTABLE KNOCKOUT ASSEMBLY FOR A PRESS SYSTEM

(75) Inventors: Edward J. Brzezniak, Orland Park, IL (US); James Washington, Bellwood, IL (US)

(73) Assignee: Aida Engineering, Ltd., Kanagawa (JP)

( * ) Notice: Subject to any disclaimer, the term of this patent is extended or adjusted under 35 U.S.C. 154(b) by 0 days.

(21) Appl. No.: 10/320,252

(22) Filed: Dec. 16, 2002

(65) Prior Publication Data

US 2004/0112111 A1 Jun. 17, 2004

(51) Int. Cl.[7] ..... B21J 13/14
(52) U.S. Cl. ..... 72/345
(58) Field of Search ..... 72/20.5, 344, 345, 72/427; 100/218

(56) References Cited

U.S. PATENT DOCUMENTS 2,546,100 A * 9/1951 Johansen et al. ..... 72/450
4,096,728 A * 6/1978 Glecker et al. ..... 72/345
4,120,185 A * 10/1978 Schneider et al. ..... 72/20.5
4,242,901 A * 1/1981 Pearson et al. ..... 72/345

* cited by examiner

*Primary Examiner*—Lowell A. Larson
(74) *Attorney, Agent, or Firm*—Wood, Phillips, Katz, Clark & Mortimer

(57) ABSTRACT

A press system having a frame, a slide, a first die element on the slide, and a knockout assembly. The slide is movable guidingly relative to the frame in a predetermined path between a first position and a second position. The first die element has a forming surface against which a workpiece can be borne to conform the workpiece to the forming surface as the slide is moved from the first position towards the second position. The knockout assembly has an ejecting element that is movable selectively relative to the first die element between extended and retracted positions. The ejecting element causes a workpiece conformed to the forming surface to be separated from the forming surface as an incident of the ejecting element moving from its retracted position into its extended position. The knockout assembly further includes a knockout bar and at least a first knockout pin. The knockout bar is movable relative to the slide between a retracted position and an extended position and causes the ejecting element to move from its retracted position into its extended position as an incident of the knockout bar moving from its retracted position and into its extended position. The at least first knockout pin causes the knockout bar to be moved from its retracted position into its extended position as an incident of the slide moving from the second position into the first position. The first knockout pin and the knockout bar have an operative relationship that is variable from a location remote from the first knockout pin.

22 Claims, 7 Drawing Sheets

CONSOLE
150
10
RESOLVER
158
SIGNAL
159
CONTROLLER
103
DRIVE
MOTOR
126
34
34
36
36
24
DRIVE
41
24
108'
154
62
12
39
40
42
110'
16
14
118'
106
44
98
44
106
160
54
52
82
DIE
ELEMENT
56
38
D
50
58
48
46
26
30
30
36
38
36
22
32
32
28
DIE
ELEMENT
60
WORKPIECE
64

ADJUSTABLE KNOCKOUT ASSEMBLY FOR A PRESS SYSTEM

BACKGROUND OF THE INVENTION

1. Field of the Invention

This invention relates to press systems and, more particularly, to a knockout assembly for parts formed on a press system.

2. Background Art

Knockout assemblies are commonly used in parts forming presses to separate the parts from die surfaces against which the parts are formed. In an exemplary press system, a translatable die element is advanced in a predetermined path to cause a workpiece blank to be formed against a surface on the die element. The forming surface may have sufficient complexity that the part will not consistently release from against the forming surface without the application of a separation force. The separation force is typically imparted through a bar on a knockout assembly.

In one known knockout assembly construction, the knockout bar has an associated element which can be selectively a) advanced through the die element and past the forming surface with the knockout bar in an extended position and b) withdrawn therefrom with the knockout bar in a retracted position. The knockout bar follows movement of a slide, which is guided in translation from a starting/first position into a second position, as an incident of which a workpiece blank is forced conformingly against the forming surface on the die element on the slide. Upon completion of the slide stroke, the slide is returned to its first position. As the slide moves back towards its first position, spaced locations on the knockout bar encounter cantilevered knockout pins which arrest further movement of the knockout bar. Continued movement of the slide towards the first position with the knockout bar blocked causes the knockout bar to translate relative to the slide, as an incident of which the knockout bar is changed from its retracted position into its extended position and, in so doing, effects separation of the formed part from against the die element surface.

Conventionally, the knockout pins have been in the form of cantilevered elements with free ends which directly contact the knockout bar. Proper operation of a knockout assembly requires a specific spatial relationship between the knockout pins and the knockout bar. If the required relationship between the knockout bar and knockout pins is not maintained, a number of different conditions could result, which could either impair performance of, or cause damage to, the press.

One such condition occurs in the event that the knockout pins do not engage the knockout bar so as to maintain its intended orientation with respect to the slide. If the knockout pins skew the knockout bar, a misalignment of the knockout bar with the slide may result which could cause uneven wear on guidingly cooperating parts, jamming, or destruction of one or more parts on the slide and/or knockout assembly.

Another more serious condition may occur in the event that the movement of the slide fully into its first position does not coincide with the movement of the knockout bar to its extended position. That is, if the knockout bar achieves its fully extended position as the slide continues to move towards its first position, the slide may be forced against the knockout pins and frame, upon which the knockout pins are mounted, so as to cause damage to be inflicted thereto and/or to the knockout assembly.

To avoid the above conditions, it is known to allow for adjustment of the knockout pins. This adjustment is desirable not only from the standpoint of avoiding the above conditions, but also to permit the press system to be set up for the performance of different operations and/or to accommodate different workpiece dimensions requiring a different slide stroke.

Heretofore, knockout pins in this type of press system have been made adjustable through manual operations performed by a technician directly at the location of the knockout pins. In one such press system, the knockout pins are elongate elements with a separate piece at the ends thereof, each of which has a surface to directly engage a knockout bar. Each end piece is threadably connected to the remainder of its associated knockout pin. By rotating the end piece, the effective length of the knockout pin can be changed. This operation needs to be performed on each of the knockout pins on the system in such a manner that their length adjustment corresponds. The effective length of the knockout pins is determined by separately taking a measurement for each adjusted knockout pin.

This manual adjustment has a number of inherent drawbacks. First of all, the technician must walk directly upon the press system components to access the knockout pins. Oft times the knockout pins are located so as not to be conveniently accessible. There is always a danger that the technician may be injured during this process. Additionally, the adjustment process is time consuming. The technician is required to climb over the equipment to each of the separate knockout pins and, through a wrench or otherwise, make the necessary adjustments. Significant down time may result. Further, the on site measuring of the altered effective length of the knockout pins through a tape measure may be awkward and imprecise. This could ultimately result in one of the conditions that is described above.

With the manually adjusted system, the operator may have to periodically visually inspect the knockout pins to make certain that they are situated and operating properly. Fine adjustments may have to be made which necessitates shutting down of the press system and proceeding again with manual adjustment. This adjustment will normally be required at each die change. Die changes may be required frequently in press operations. A die change may take 45 minutes for a 15 minute run. Thus minimizing down time may become extremely important to press efficiency.

A further problem with the manual adjustment is that it may require a considerable amount of trial and error to make certain that the operative relationship between the slide, frame, knockout pins, and knockout bar is as desired. This process is inconvenient and time consuming as it may require several test adjustments and test runs before full operation is undertaken.

SUMMARY OF THE INVENTION

In one form, the invention is directed to a press system having a frame, a slide, a first die element on the slide, and a knockout assembly. The slide is movable guidingly relative to the frame in a predetermined path between a first position and a second position. The first die element has a forming surface against which a workpiece can be borne to conform the workpiece to the forming surface as the slide is moved from the first position towards the second position. The knockout assembly has an ejecting element that is movable selectively relative to the first die element between extended and retracted positions. The ejecting element causes a workpiece conformed to the forming surface to be separated from the forming surface as an incident of the ejecting element moving from its retracted position into its extended position. The knockout assembly further includes a knockout bar and at least a first knockout pin. The knockout bar is movable relative to the slide between a retracted position and an extended position and causes the ejecting element to move from its retracted position into its extended position as an incident of the knockout bar moving from its retracted position and into its extended position. The at least first knockout pin causes the knockout bar to be moved from its retracted position into its extended position as an incident of the slide moving from the second position into the first position. The first knockout pin and the knockout bar have an operative relationship that is variable from a location remote from the first knockout pin.

In one form, the knockout bar is movable guidingly relative to the slide between its extended and retracted position.

In one form, the at least first knockout pin has a first surface. With the knockout bar in its retracted position and the slide in the second position, the first surface is spaced from the knockout bar a first distance. The operative relationship between the first knockout pin and the knockout bar is variable by changing the first distance.

In one form, the first knockout pin is part of a first knockout pin assembly. The first knockout pin assembly includes a selectively operable first advancing element for repositioning the first knockout pin relative to the frame so as to thereby selectively change the first distance. The knockout assembly further has a drive for operating the first advancing element.

In one form, the advancing element is a part of a screw jack that is operated by a motor.

In one form, as the slide is moved from the second position into the first position, the first surface of the first knockout pin comes into engagement with the knockout bar at a first location.

In one form, the knockout assembly includes a second knockout pin assembly with a second knockout pin. The second knockout pin has a second surface that is engageable with the knockout bar. With the knockout bar in its retracted position and the slide in the second position, the second surface is spaced from the knockout bar a second distance. The operative relationship between the second knockout pin and the knockout bar is variable from a location remote from the second knockout pin.

In one form, the second knockout pin assembly includes a selectively operable second advancing element for repositioning the second knockout pin relative to the frame so as to thereby selectively change the second distance.

In one form, the second advancing element is operated by the drive.

In one form, the first advancing element is a part of a first jack and the second advancing element is part of a second jack. The first and second jacks are interconnected so that operation of the first and second advancing elements is synchronized.

In one form, the first advancing element can be adjusted independently of the second advancing element.

The press system may further include at least a first sensor for detecting at least one of a) a first relationship between the first knockout pin and the frame; and b) a second relationship between the first knockout pin and the knockout bar with the first knockout pin and knockout bar positioned relative to each other and the frame in a predetermined manner, and causing the production of signals indicative of the first and second relationships.

The press system may further include a controller for receiving the signals from the at least first sensor.

The press system may further include a drive that is operable through the controller to selectively change the first and second relationships.

In one form, the press system further includes at least a first resolver which generates signals to the controller useable to automatically maintain a selected first and second relationships through the controller.

The press system may further include at least a second sensor for detecting a third relationship between the slide and the frame and causing the production of signals to the controller indicative of the third relationship.

The press system may further include a second resolver which generates signals to the controller useable to automatically maintain a selected third relationship through the controller.

The invention is further directed to a press system including a frame, a slide, a first die element, and a knockout assembly. The slide is movable guidingly relative to the frame in a predetermined path between a first position and a second position. The first die element has a forming surface against which a workpiece can be borne to conform the workpiece to the forming surface as the slide is moved from the first position toward the second position. The knockout assembly has an ejecting element that is movable selectively relative to the first die element between extended and retracted positions. The ejecting element causes a workpiece conformed to the forming surface to be separated from the forming surface as an incident of the ejecting element moving from its retracted position into its extended position. The knockout assembly further includes a knockout bar and at least a first knockout pin. The knockout bar is movable relative to the slide between a retracted position and an extended position and causes the ejecting element to move from its retracted position into its extended position as an incident of the knockout bar moving from its retracted position into its extended position. The at least first knockout pin causes the knockout bar to be moved from its retracted position into its extended position as an incident of the slide moving from the second position into the first position. The knockout assembly further includes a powered drive. The at least first knockout pin and the knockout bar have an operative relationship that is variable by operating the powered drive.

The invention is further directed to a method of operating a press of the type described above, wherein the method includes the step of selectively varying the operative relationship between the first knockout pin and the knockout bar through a controller.

The method may further include the steps of generating signals indicative of the operative relationship between the first knockout pin and knockout bar and monitoring the operative relationship between the first knockout pin and the knockout bar through the signals.

The method may further include the steps of selecting a desired operative relationship between the first knockout pin and knockout bar through the controller, monitoring the operative relationship and producing signals indicative of the operative relationship, and through the controller processing the signals and in response thereto causing variation in the operative relationship between the first knockout pin and knockout bar necessary to maintain the desired operative relationship.

The method may further include the steps of monitoring an operative relationship between the slide and the frame and causing the production of signals to the controller indicative of the operative relationship between the slide and the frame.

The method may further include the steps of selecting a desired operative relationship between the slide and the frame, monitoring the operative relationship and producing signals indicative of the operative relationship, and through the controller processing the signals and thereby causing any necessary variation in the operative relationship between the slide and the frame to maintain the desired operative relationship between the slide and frame.

DETAILED DESCRIPTION OF THE DRAWINGS

Figure 1:
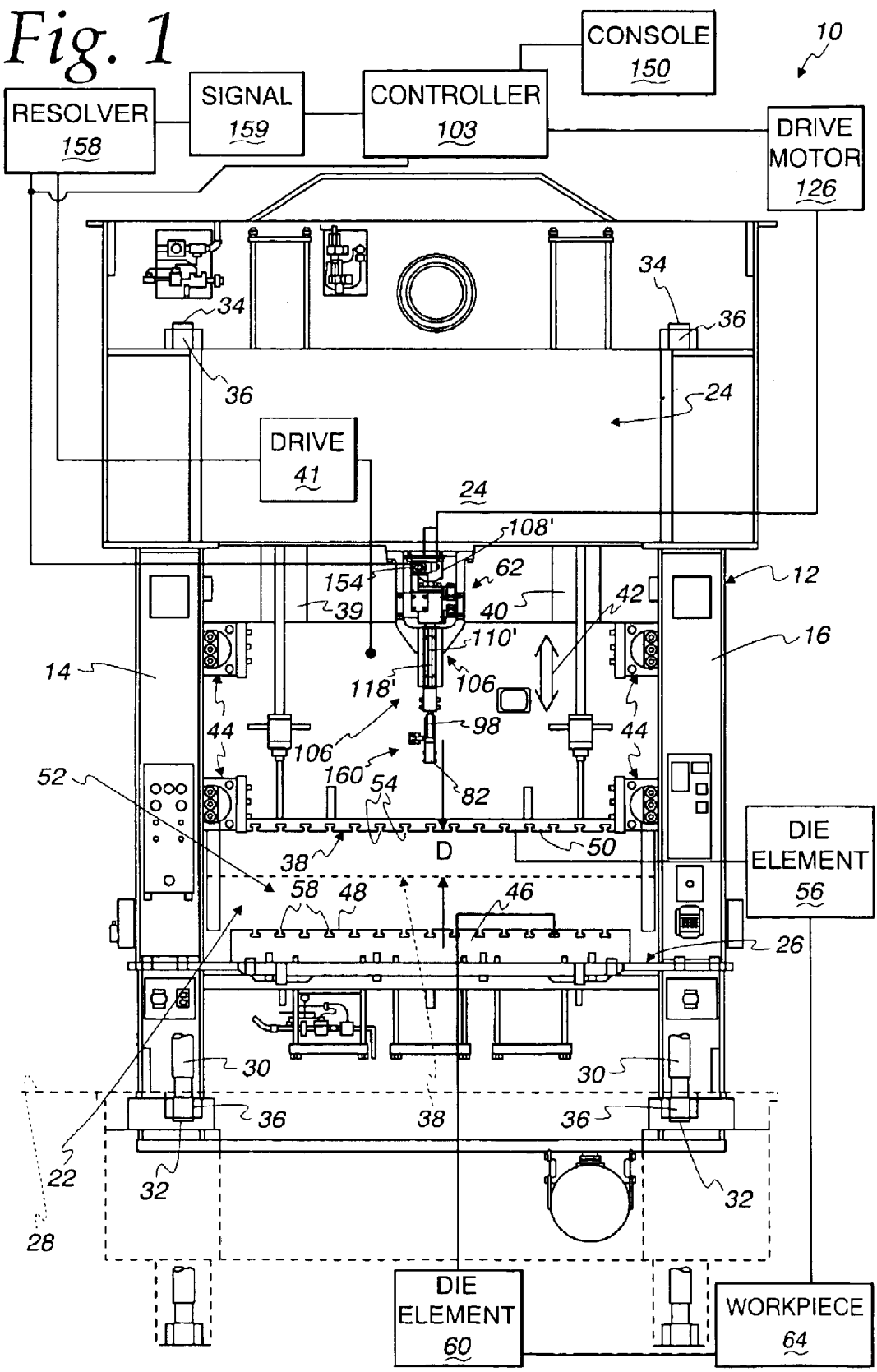
FIG. 1 is a front elevation view of a press system incorporating a knockout assembly for separating formed workpieces from a die element, according to the present invention.
Figure 2:
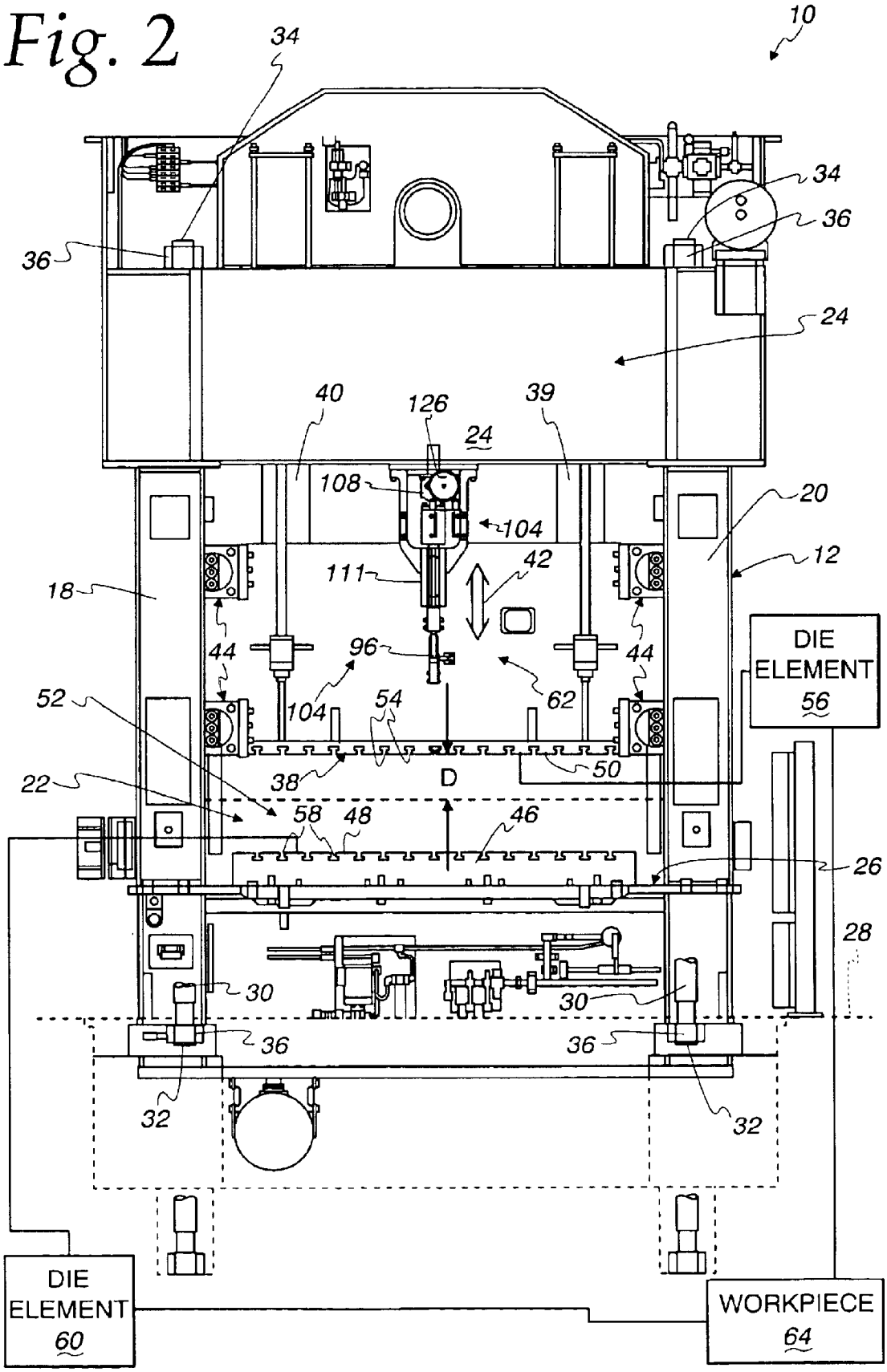
FIG. 2 is a rear elevation view of the press system in FIG. 1.
Figure 3:
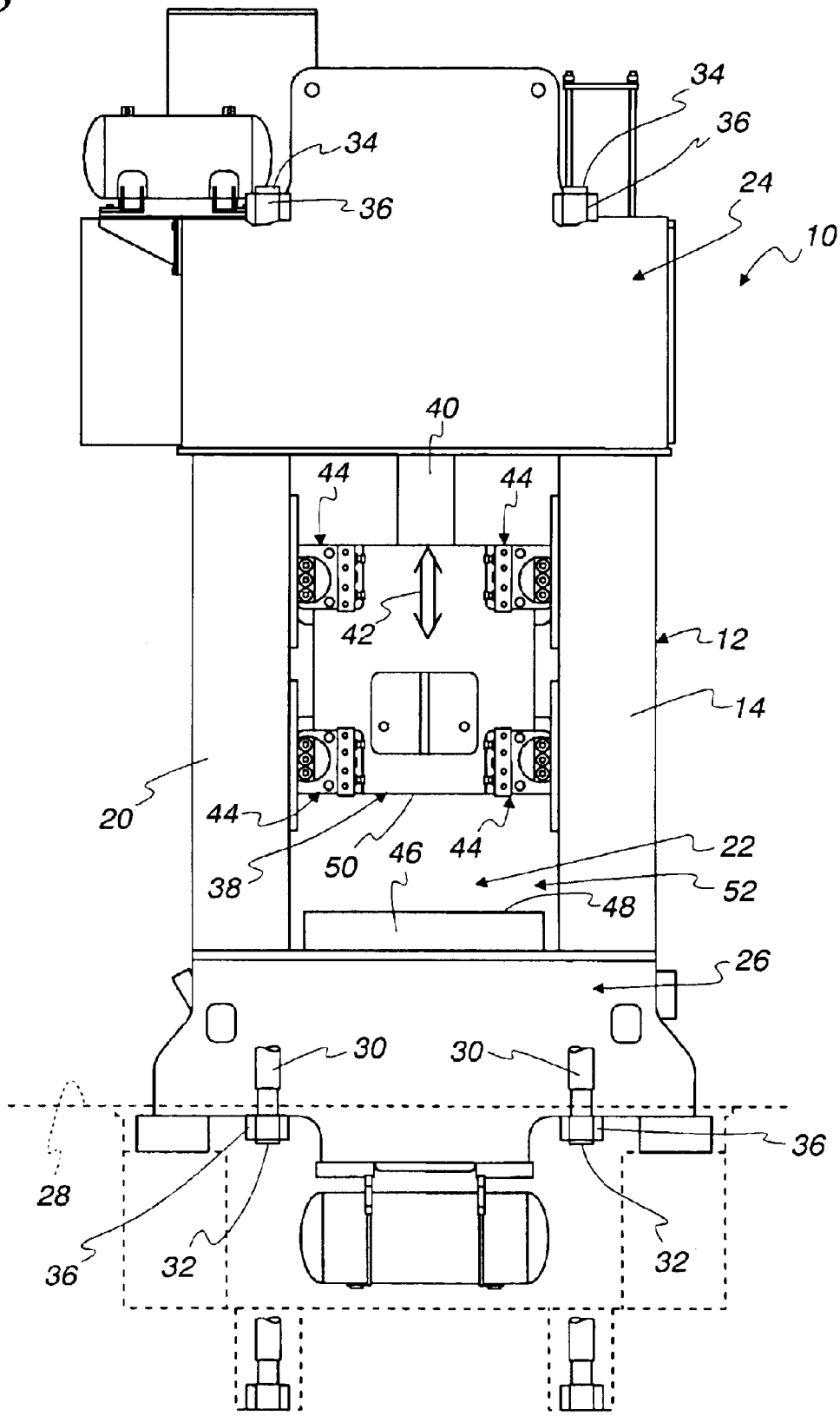
FIG. 3 is a left side elevation view of the press system in FIGS. 1 and 2.

Referring initially to FIGS. 1–3, a press system with the present invention incorporated therein, is shown at 10. It is necessary to understand only the general operation of the press system 10 as one representative environment for the present invention. The inventive structure could be utilized in press systems having configurations substantially different than that of the press system 10 shown.

Briefly, the press system 10 consists of a frame 12 having four vertically extending, elongate columns 14, 16, 18, 20 which bound an operating space 22. The columns 14, 16, 18, 20 extend, and connect, between an overhead crown assembly 24 and a bed assembly 26, with the latter being implanted through a support surface 28. The columns 14, 16, 18, 20, crown assembly 24, and bed assembly 26 are united through tie rods 30, each extending through a column 14, 16, 18, 20, the crown assembly 24, and the bed assembly 26, so that opposite, threaded rod ends 32, 34 are exposed at the bed assembly 26 and crown assembly 24, respectively, so as to accept a nut 36. By tightening the nuts 36, a unitary assembly, with the columns 14, 16, 18, 20 captive between the crown assembly 24 and the bed assembly 26, results.

A slide/slide assembly 38 is suspended from the crown assembly 24 by two connecting rods 39,40. The connecting rods 39,40 have lower ends (not shown) which are attached to the slide assembly 38 at spaced locations through connections that permit guided, universal, movement between the lower end of each rod 39, 40 and the slide assembly 38. The manner of vertically repositioning the slide assembly 38 is likewise not important to the present invention. Virtually any known mechanism can be used to change the slide assembly 38 between a first/raised position, as shown in solid lines in FIGS. 1–3, and a second/lowered position, shown in dotted lines in FIG. 1. The distance D between the solid and dotted line positions for the slide assembly 38 represents the slide assembly stroke length for a particular application. The stroke length/distance D shown is intended only to be representative in nature. While the press stroke is not variable in the press system 10 shown, press systems are well known in which the stroke is variable so that the stroke may be changed depending upon the dimensions of a workpiece to be processed and the nature of the processing to be carried out.

Through a main drive 41 on the crown assembly 24, as shown schematically in FIG. 1, the slide assembly 38 is selectively raised and lowered through the connecting rods 39, 40, moving guidingly against the frame 12 vertically upwardly and downwardly, as indicated by the double-headed arrow 42. The slide assembly 38 is guided in vertical movement by the columns 14, 16, 18, 20 at the four comers of the slide assembly 38. At the top and bottom of each corner, a guide assembly 44, each of the same construction, is provided. The guide assemblies 44 are described in greater detail in copending application Ser. No. 101002,731, the disclosure of which is incorporated herein by reference.

A bolster 46 is mounted to the bed assembly 26 so as to situate an upwardly facing, flat, mounting surface 48 substantially parallel to a downwardly facing, flat mounting surface 50 at the bottom of the slide assembly 38. The flat surfaces 48, 50 cooperatively bound a die operating space 52. The slide assembly 38 has a series of parallel, T-shaped, elongate, fore-and-aft slots 54 formed through the surface 50 thereon to accommodate conventional, complementary structure for mounting to the slide assembly 38 a die element 56. The bolster 46 has similar, parallel slots 58 that are complementary to the mounting structure on a separate, cooperating die element 60.

The present invention is concerned with a knockout assembly at 62 which functions to expel a workpiece 64, formed by cooperation between the die elements 56,60 as the slide assembly 38 moves from the first/raised position into the second/lowered position, that tends to adhere to the die element 56, thereby following movement of the retracting slide assembly 38.

Figure 4:
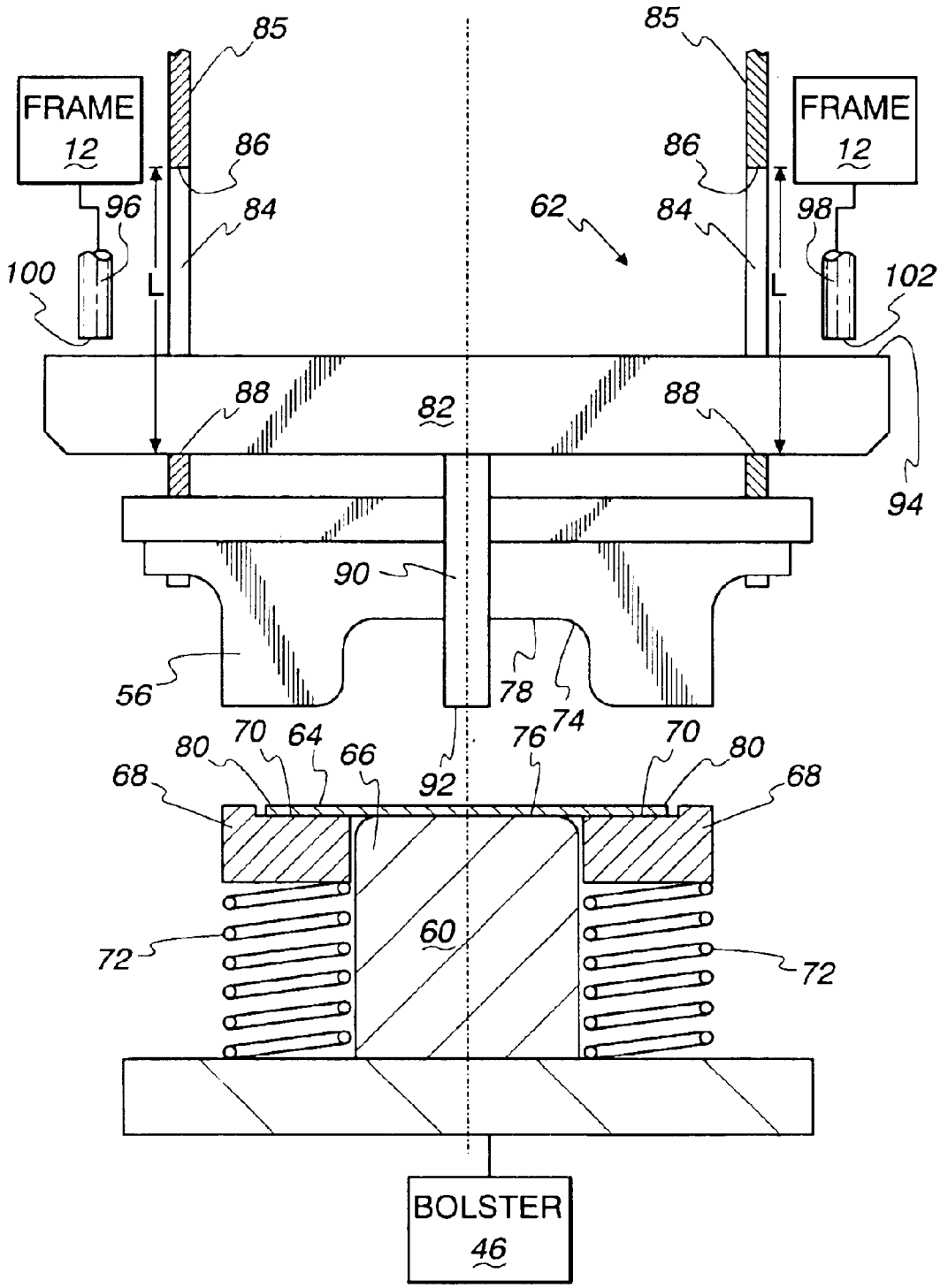
FIG. 4 is a schematic representation of the press system in FIGS. 1–3 and showing cooperating die elements in a position preparatory to workpiece formation.
Figure 5:
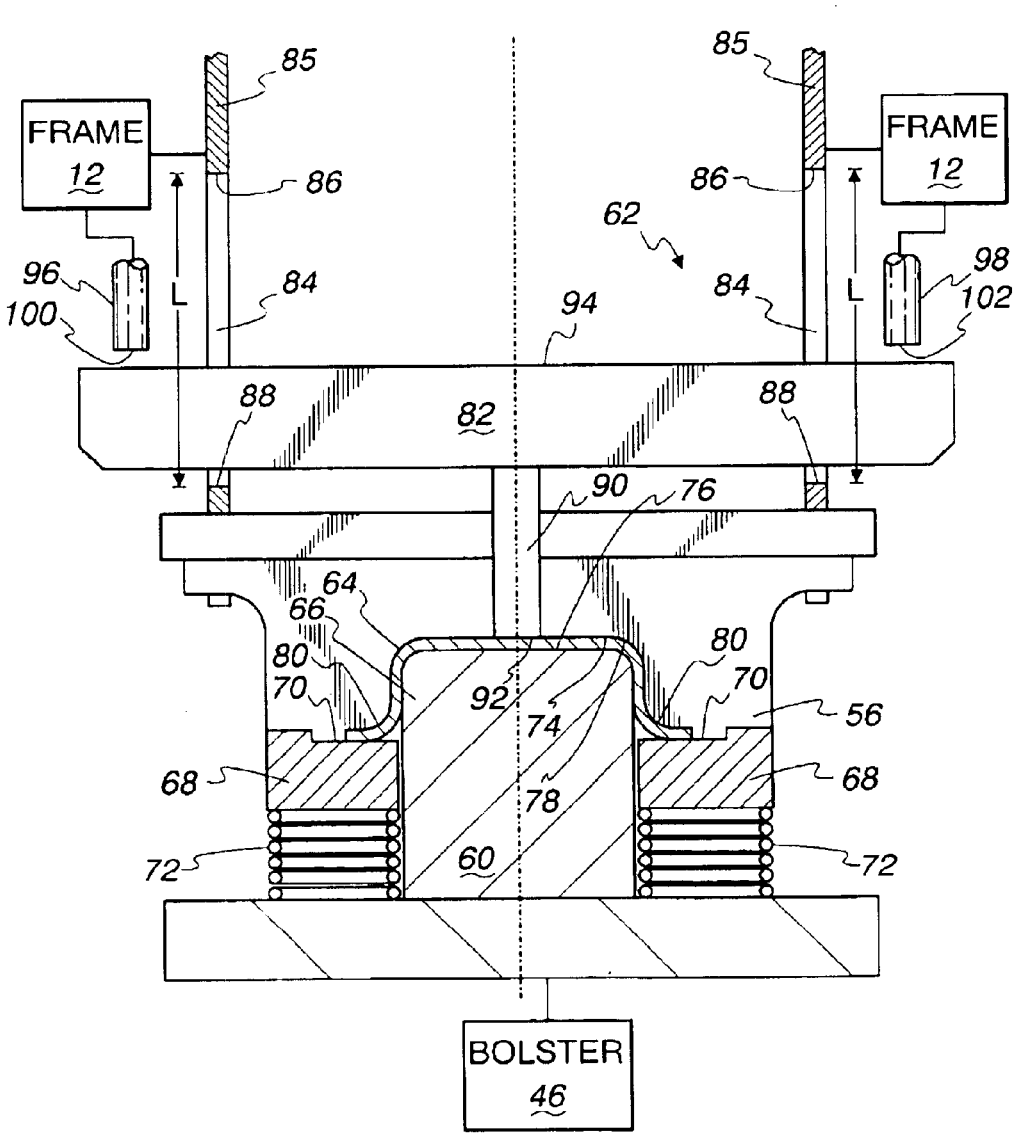
FIG. 5 is a view as in FIG. 4 with the die elements situated to fully form the workpiece.

Referring now to FIGS. 4 and 5, a schematic representation of the knockout assembly 62 and die elements 56, 60 is shown to facilitate a general explanation of the operation of these structures. The die element 60 has a projection 66 adjacent to which cushioning pads 68 are placed. The cushioning pads 68 each have an undercut, upwardly facing, upper surface 70 and are urged normally upwardly by biasing mechanisms/springs 72. The die element 56 has a cavity 74 that is complementary to the shape of the outer forming surface 76 of the projection 64 on the die element 60. The workpiece blank 64 is initially placed between the die elements 56, 60, as upon the projection 66. By advancing the slide assembly 38 downwardly from the first/raised position towards the second/lowered position, a forming surface 78, bounding the cavity 74 which receives the projection 66, bears upon the workpiece blank 64 and progressively causes the workpiece blank 64 to conform to the complementary forming surfaces 76, 78 of the die elements 60, 56, respectively. With the slide assembly 38 fully lowered to its second position, the workpiece blank 64 assumes the shape shown in FIG. 5. The edges 80 of the workpiece blank 62 nest against the undercut surfaces 70 on the cushioning pads 68. The cushioning pads 68 maintain the edges 80 substantially horizontally oriented as the workpiece blank 64 is wrapped conformingly against the projection 66. Of course, it should be kept in mind that the particular workpiece formation that is shown is intended only to be illustrative, as any press forming process with virtually any type of die element or elements is contemplated.

Once the workpiece blank 64 is formed to the FIG. 5 shape, the slide assembly 38 can be raised towards its first position. As this occurs, the biased cushioning pads 68 maintain the formed workpiece 64 pressed upwardly against the surface 78 of the upper die element 56 so that the workpiece 64 separates 20 from the projection 66. Depending upon the shape of the cavity 74, during retraction of the slide assembly 38, the formed workpiece blank 64 may either release from the die element 56 or become wedged therein so as to continue to follow the upward movement of the die element 56 as the slide assembly 38 is raised.

The knockout assembly 62 is constructed so as to expel the formed workpiece 64 from the cavity 74 as an incident of the slide assembly 38 retracting towards its first position and carrying the die element 56 with the formed workpiece 64 therewith. The knockout assembly 62 consists of knockout bar 82 which moves guidingly within a slot 84 through spaced legs 85 on the slide assembly 38. The slot 84 has a vertical dimension L in each leg 85 bound by downwardly and upwardly facing edges 86, 88 which respectively limit upward and downward translational movement of the knockout bar 82.

The knockout bar 82 has an associated ejecting element 90 which follows movement of the knockout bar 82. With the slide assembly 38 in the FIG. 4 position, i.e., at or near the first position, the knockout bar 82, under its own weight and that of the ejecting element 90, moves downwardly into its extended position wherein the knockout bar 82 bears on the upwardly facing edges 88. In the extended position for the knockout bar 82, the ejecting element 90 projects through the die element 56 and past the forming surface 78. As the slide assembly 38 continues downwardly from its FIG. 4 position towards its second, lowered position, the bottom 92 of the ejecting element 90 encounters the workpiece 64 that is bearing upon the upwardly facing portion of the forming surface 76. Continued downward movement of the slide assembly 38 causes the ejecting element 90 and knockout bar 82 to be pressed upwardly to a point that the bottom 92 of the ejecting element 90 becomes flush with the forming surface 78 so as not to interfere with the formation of the workpiece 64. The forming process for the workpiece 64 is completed upon the slide assembly 38 nearing or reaching the second position therefor. The slide assembly 38 is thereafter retracted, being moved upwardly towards its first position. As this upward movement continues, the upper edge 94 of the knockout bar 82 encounters a pair of spaced knockout pins 96, 98 which are supported upon the frame 12. As explained in greater detail hereinafter, the knockout pins 96, 98 are adjustable to change the vertical position of downwardly facing surfaces 100, 102 on the knockout pins 96, 98, respectively, relative to the frame 12, and thereby the operative relationship of the knockout pins 96, 98 and knockout bar 82. The adjustment is effected so that the ejection of the workpieces 64 is accomplished without permitting the knockout pins 96, 98 to engage the knockout bar 82 with the knockout bar 82 bearing upon the upwardly facing edge 88. This avoids damage to the knockout pins 96, 98, the knockout bar 82, and the slide assembly 38.

Traditionally, the pickup pins 96, 98 are adjusted manually, one by one, at their site by a technician to vary the vertical position of the surfaces 100, 102 relative to the frame 12. The vertical adjustment is required to avoid a "crash" situation, described above, and to ensure the required ejecting movement of the knockout bar 82 and ejecting element 90 as the slide assembly 38 is moved from its second position towards its first position after the formation of the workpiece 64.

According to the invention, the vertical location of the surfaces 100, 102 of the knockout pins 96, 98 is monitored and adjusted through a controller 103, as shown in FIGS. 1, 2 and 6–8. The knockout assembly 62 consists of a first knockout pin assembly 104 and a second knockout pin assembly 106, each depending from the crown assembly 24. The first knockout pin assembly 104 consists of a first screw jack 108 mounted to the crown assembly 24 and having a first vertically movable element 109 for repositioning the knockout pin 96. One suitable screw jack is Duff-Norton's Model No. 9015 worm gear operated screw jack. The movable element 109 on the screw jack 108 is connected to, and vertically drives, a hollow guide tube 110 that slides within a bracket/guide sleeve 111 on the frame 12. The lower end of the guide tube 110 is secured to the knockout pin 96 through a clamp assembly at 112. By rotating an input element 113 on the screw jack 108 about an axis 114, the guide tube 110, and the knockout pin 96 attached thereto, are moved guidingly vertically to thereby cause the knockout pin 96 to change between its extended and retracted positions. A bracket 124 is cantilever mounted to the guide sleeve 111 and supports a drive motor 126 for operating the screw jack 108. The motor shaft 128 is connected to the input element 113 on the screw jack 108 through a flexible coupling 132.

The second knockout pin assembly 106 has a similar construction to the first knockout pin assembly 104, with a second screw jack 108' from which a second bracket/guide sleeve 111' depends. The guide sleeve 111' guides vertical translatory movement of a guide tube 110', to which the knockout pin 98 is attached through a clamp assembly 112', between extended and retracted positions.

The screw jacks 108, 108' are operatively interconnected for synchronous operation by a drive shaft 136. The drive shaft 136 has one end 138 connected to an output shaft 140 on the first screw jack 108 through a flexible coupling 142 and an opposite end 144 connected to an input shaft 146 on the second screw jack 108' through a flexible coupling 148. By operating the drive motor 126, the knockout pins 96, 98 can be simultaneously extended and retracted through an adjustment range that may be on the order of six inches. A drive motor 126 of approximately one horsepower capacity may be suitable for this purpose. The drive motor 126 is selectively operable through the controller 103. The operator may program and operate the controller 103 through a console 150 spaced at a convenient location remote from the knockout pins 96, 98.

A mounting bracket 152 is cantilever mounted to the guide sleeve 111' and supports a resolver 154 which attaches to an output shaft 156 on the second screw jack 108'. The resolver 154 determines the degree of angular movement of the output shaft 156, which can be correlated to a vertical movement of the knockout pins 96, 98. A monitoring signal 157 from the resolver 154 can be communicated to the controller 103. A the console 150, using the data generated by the signal 157, the operator can monitor the position of the knockout pins 96, 98 and make an appropriate adjustment thereto. Preferably, it is also possible to independently operate the screw jacks 108, 108' and to monitor their operation, i.e., the position of the knockout pins 96, 98, at the console 150 to make this independent adjustment therefrom.

As shown in FIG. 1, a separate resolver 158 can be operatively connected to a rotary element associated with the drive 41 to produce a signal 159 that allows conversion of the drive operation into vertical positional data through the controller 103. Accordingly, the position of the slide assembly 38 can be monitored and adjusted from the console 150. With this arrangement, by having the resolvers 154, 158 communicating with each other and the controller 103, the operative relationships between a) the slide assembly 38 and the knockout pins 96, 98, b) the knockout pins 96, 98 and the frame 12, and c) the slide assembly 38 and the frame 12 can be monitored and adjusted through the console 150 and controller 103 for fully automatic operation of the knockout assembly 62 from a remote location without requiring direct access to the knockout assembly 62 by a technician.

Figure 6:
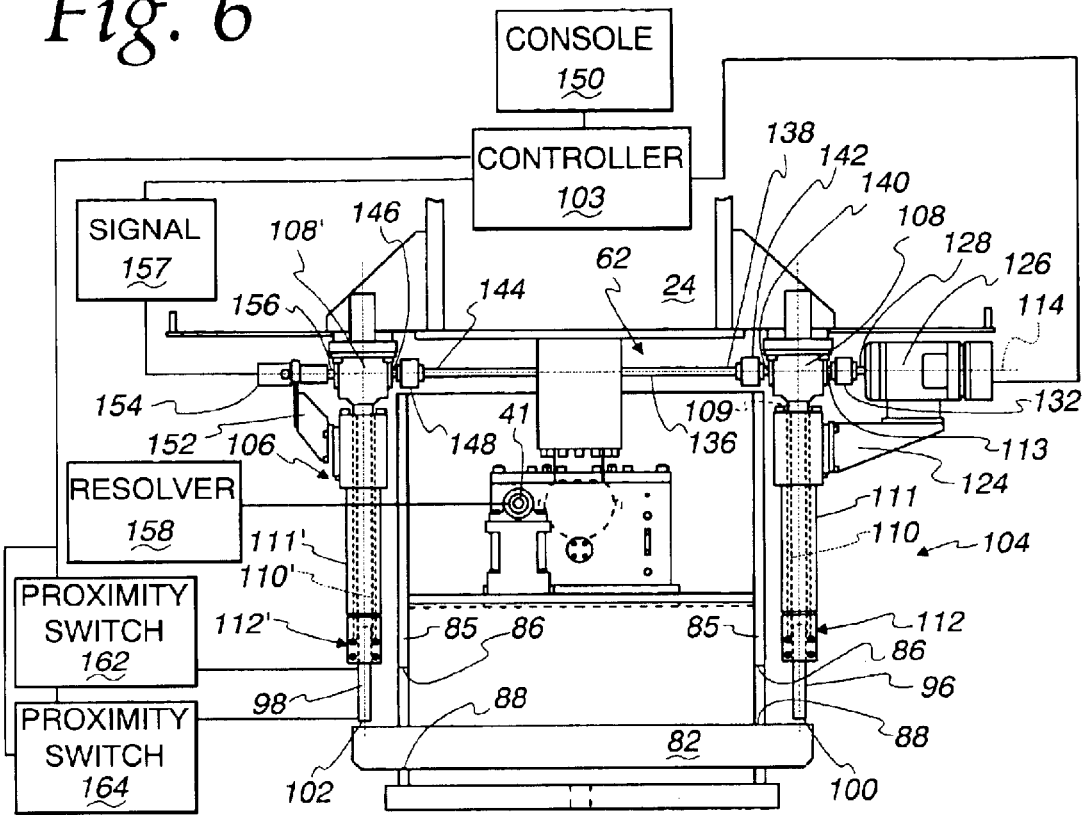
FIG. 6 is an enlarged, fragmentary, side elevation view of the inventive knockout assembly on the press system in FIGS. 1–3.
Figure 7:
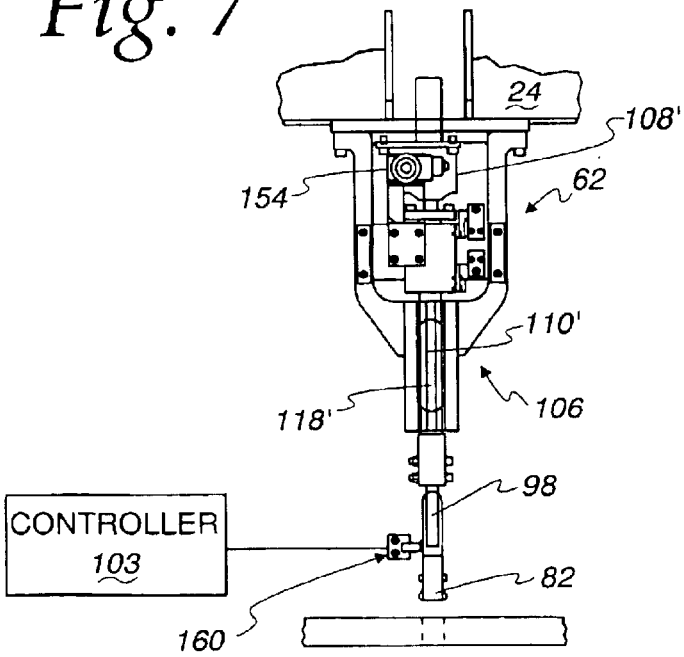
FIG. 7 is an enlarged, fragmentary, front elevation view of the inventive knockout assembly.
Figure 8:
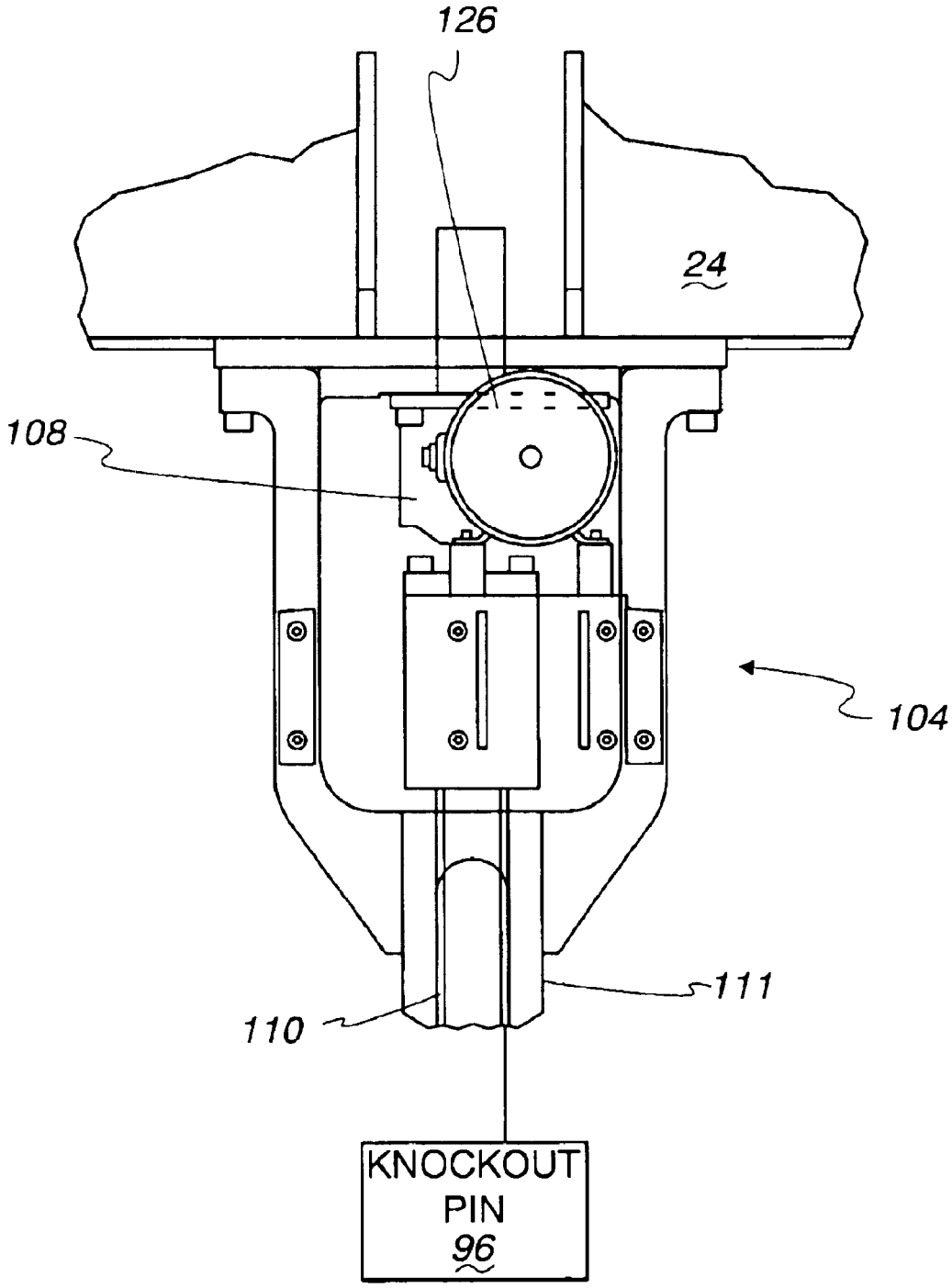
FIG. 8 is an enlarged, fragmentary, rear elevation view of a screw jack for adjusting a knockout pin on the inventive knockout assembly.

Another aspect of the invention is the incorporation of a safeguard against a collision between the knockout bar 82 and the knockout pins 96, 98 with the slide assembly 38 in its first position. i.e., top dead center, as shown in FIGS. 6 and 7. To accomplish this, a proximity switch at 160 (FIG. 7) detects the relationship between the knockout bar 82 and the knockout pin 98. The proximity switch 160 generates a signal to the controller 103 which can be usable to maintain a desired spacing between the knockout pin 98 and the knockout bar 82 in the relative position shown in FIGS. 6 and 7.

Further, as shown in FIG. 6, proximity switches 162, 164 can be utilized to calibrate the maximum raised and lowered positions, respectively, for one or both of the knockout pins 96, 98. The maximum raised position may be set to avoid potential damage inflicted through automatic or manual slide adjustment.

The invention permits system adjustments during a die change sequence and monitoring and adjustment during operation from the console 150.

The foregoing disclosure of specific embodiments is intended to be illustrative of the broad concepts comprehended by the invention.

What is claimed is:

1. A press system comprising:

a frame;

a slide that is movable guidingly relative to the frame in a predetermined path between a first position and a second position;

a first die element on the slide and having a forming surface against which a workpiece can be borne to conform the workpiece to the forming surface as the slide is moved from the first position towards the second position; and a knockout assembly comprising an ejecting element that is movable selectively relative to the first die element between extended and retracted positions, the ejecting element causing a workpiece conformed to the forming surface to be separated from the forming surface as an incident of the ejecting element moving from the retracted position into the extended position, the knockout assembly further comprising a knockout bar and at least a first knockout pin, the knockout bar movable relative to the slide between a retracted position and an extended position and causing the ejecting element to move from its retracted position into its extended position as an incident of the knockout bar moving from its retracted position into its extended position, the at least first knockout pin causing the knockout bar to be moved from its retracted position into its extended position as an incident of the slide moving from the second position into the first position, the first knockout pin and the knockout bar having an operative relationship that is variable from a location remote from the first knockout pin, wherein the knockout bar is movable guidingly relative to the slide between its extended and retracted positions, wherein the at least first knockout pin has a first surface, with the knockout bar in its retracted position and the slide in the second position the first surface is spaced from the knockout bar a first distance, and the operative relationship between the first knockout pin and the knockout bar is variable by changing the first distance.

2. The press system according to claim 1 wherein the first knockout pin is part of a first knockout pin assembly, the first knockout pin assembly comprises a selectively operable first advancing element for repositioning the first knockout pin relative to the frame so as to thereby selectively change the first distance, and the knockout assembly further comprises a drive for operating the first advancing element.

3. The press system according to claim 1 wherein the advancing element is part of a screw jack that is operated by a motor.

4. The press system according to claim 1 wherein as the slide is moved from the second position into the first position the first surface of the first knockout pin comes into engagement with the knockout bar at a first location.

5. The press system according to claim 1 wherein the knockout assembly comprises a second knockout pin assembly with a second knockout pin, the second knockout pin has a second surface that is engageable with the knockout bar, with the knockout bar in its retracted position and the slide in the second position the second surface is spaced from the knockout bar a second distance, and the second knockout pin and the knockout bar have an operative relationship that is variable from a location remote from the second knockout pin.

6. The press system according to claim 5 wherein the second knockout pin assembly comprises a selectively operable second advancing element for repositioning the second knockout pin relative to the frame so as to thereby selectively change the second distance.

7. The press system according to claim 6 wherein the second advancing element is operated by the drive.

8. The press system according to claim 6 wherein the first advancing element is a part of a first jack and the second advancing element is a part of a second jack and the first and second jacks are interconnected so that operation of the first and second advancing elements is synchronized.

9. The press system according to claim 8 wherein the first advancing element can be adjusted independently of the second advancing element.

10. The press system according to claim 1 further comprising at least a first sensor for detecting at least one of: a) a first relationship between the first knockout pin and the frame; and b) a second relationship between the first knockout pin and the knockout bar with the first knockout pin and knockout bar positioned relative to each other and the frame in a predetermined manner and causing the production of signals indicative of the first and second relationships.

11. The press system according to claim 10 further comprising a controller for receiving the signals from the at least first sensor.

12. The press system according to claim 11 further comprising a drive that is operable through the controller to selectively change the first and second relationships.

13. The press system according to claim 12 further comprising at least a first resolver which generates signals to the controller usable to automatically maintain a selected first and second relationship through the controller.

14. The press system according to claim 13 further comprising at least a second sensor for detecting a third relationship between the slide and the frame and causing the production of signals to the controller indicative of the third relationship.

15. The press system according to claim 14 further comprising at least a second resolver which generates signals to the controller useable to automatically maintain a selected third relationship through the controller.

16. A press system comprising:

a frame;

a slide that is movable guidingly relative to the frame in a predetermined path between a first position and a second position;

a first die element on the slide and having a forming surface against which a workpiece can be borne to conform the workpiece to the forming surface as the slide is moved from the first position towards the second position; and a knockout assembly comprising an ejecting element that is movable selectively relative to the first die element between extended and retracted positions, the ejecting element causing a workpiece conformed to the forming surface to be separated from the forming surface as an incident of the ejecting element moving from the retracted position into the extended position, the knockout assembly further comprising a knockout bar and at least a first knockout pin, the knockout bar movable guidingly relative to the slide between a retracted position and an extended position and causing the ejecting element to move from its retracted position into its extended position as an incident of the knockout bar moving from its retracted position into its extended position, the at least first knockout pin causing the knockout bar to be moved from its retracted position into its extended position as an incident of the slide moving from the second position into the first position, the knockout assembly further comprising a powered drive, the at least first knockout pin and the knockout bar having an operative relationship that is variable by operating the powered drive, wherein the at least first knockout pin has a first surface, with the knockout bar in its retracted position and the slide in the second position the first surface is spaced from the knockout bar a first distance, and the operative relationship between the first knockout pin and the knockout bar is variable by changing the first distance.

17. A method of operating a press system of the type comprising; a frame; a slide that is movable guidingly relative to the frame in a predetermined path between a first position and a second position; a first die element on the slide and having a forming surface against which a workpiece can be borne to conform the workpiece to the forming surface as the slide is moved from the first position towards the second position; and a knockout assembly comprising an ejecting element that is movable selectively relative to the first die element between extended and retracted positions, the ejecting element causing a workpiece conformed to the forming surface to be separated from the forming surface as an incident of the ejecting element moving from the retracted position into the extended position, the knockout assembly further comprising a knockout bar and at least a first knockout pin, the knockout bar movable relative to the slide between a retracted position and an extended position and causing the ejecting element to move from its retracted position into its extended position as an incident of the knockout bar moving from its retracted position into its extended position, the at least first knockout pin causing the knockout bar to be moved from its retracted position into its extended position as an incident of the slide moving from the second position into the first position, the first knockout pin having a first surface, and with the knockout bar in the retracted position and the slide in the second position, the first surface is spaced from the knockout bar a first distance, the first knockout pin and the knockout bar having an operative relationship, the method comprising the steps of:

selectively varying the operative relationship between the first knockout pin and the knockout bar by varying the first distance through a controller.

18. The method of operating a press system according to claim 17 further comprising the steps of generating signals indicative of the operative relationship between the first knockout pin and knockout bar and monitoring the operative relationship between the first knockout pin and the knockout bar through the signals.

19. The method of operating a press system according to claim 17 further comprising the steps of selecting a desired operative relationship between the first knockout pin and knockout bar through the controller, monitoring the operative relationship and producing signals indicative of the desired operative relationship, and through the controller processing the signals and in response thereto causing variation in the operative relationship between the first knockout pin and knockout bar necessary to maintain the desired operative relationship.

20. The method of operating a press system according to claim 19 further comprising the steps of selecting a desired operative relationship between the slide and the frame, monitoring the desired operative relationship between the slide and the frame and producing signals indicative of the operative relationship between the slide and the frame, and through the controller processing the signals indicative of the operative relationship between the slide and the frame and thereby causing any necessary variation in the operative relationship between the slide and the frame to maintain the desired operative relationship between the slide and the frame.

21. The method of operating a press system according to claim 17 further comprising the steps of monitoring an operative relationship between the slide and the frame and causing the production of signals to the controller indicative of the operative relationship between the slide and the frame.

22. The method of operating a press system according to claim 17 further comprising the steps of selecting a desired operative relationship between the slide and the frame, monitoring the operative relationship and producing signals indicative of the operative relationship, and through the controller processing the signals and thereby causing any necessary variation in the operative relationship between the slide and the frame to maintain the desired operative relationship between the slide and frame.

* * * * *